US005537742A

United States Patent [19]

Le et al.

[11] Patent Number: 5,537,742

[45] Date of Patent: Jul. 23, 1996

[54] METHOD FOR JOINING MULTIPLE CONDUCTOR CABLES

[75] Inventors: Huu V. Le, Wilbraham, Mass.; Michael W. Farslow, Bristol, Conn.; Jack J. Chen, West Hartford, Conn.; Michael S. Yarnall, Windsor, Conn.

[73] Assignee: General Signal Corporation, Stamford, Conn.

[21] Appl. No.: 446,475

[22] Filed: May 22, 1995

[51] Int. Cl.[6] ..... H01R 43/00

[52] U.S. Cl. ..... 29/869; 156/49; 174/84 R

[58] Field of Search ..... 174/84 R; 29/869, 29/868; 156/49; 264/272.14

[56] References Cited

U.S. PATENT DOCUMENTS

| | | | |
|---|---|---|---|
| 2,312,652 | 3/1943 | Komives et al. | 156/49 X |
| 2,536,173 | 1/1951 | Hamilton | 156/49 |
| 3,187,088 | 6/1965 | Warner | 174/84 R X |
| 3,717,717 | 2/1973 | Cunningham et al. | 156/49 X |
| 4,057,187 | 11/1977 | Cranston et al. | 228/107 |
| 4,392,014 | 7/1983 | Trumble et al. | 174/92 |
| 4,484,022 | 11/1984 | Eilentropp | 174/84 R |
| 4,487,994 | 12/1984 | Bahder | 174/73 R |
| 4,589,939 | 5/1986 | Mohebban et al. | 156/49 |
| 4,654,474 | 3/1987 | Charlebois et al. | 174/88 R |
| 4,678,866 | 7/1987 | Charlebois | 174/88 R |
| 4,822,952 | 11/1989 | Katz et al. | 174/73.1 |
| 4,894,488 | 1/1990 | Gupta | 174/28 |
| 4,965,411 | 10/1990 | Bruneval | 174/89 |
| 4,976,796 | 12/1990 | Feitzelmayer | 156/49 |
| 5,194,692 | 3/1993 | Gallusser et al. | 174/36 |
| 5,234,515 | 8/1993 | Sekkelsten | 156/49 |
| 5,298,101 | 3/1994 | Babiel et al. | 156/273.9 |
| 5,374,784 | 12/1994 | Wentzel | 174/84 R X |

FOREIGN PATENT DOCUMENTS

| | | | |
|---|---|---|---|
| 1564 | 5/1979 | European Pat. Off. | 174/84 R |
| 1184617 | 7/1959 | France | 174/94 R |
| 2320273 | 11/1974 | Germany | 174/84 R |
| 204005 | 11/1983 | Germany | 174/84 R |

*Primary Examiner*—Carl J. Arbes

*Attorney, Agent, or Firm*—Ohlandt, Greeley, Ruggiero & Perle

[57] ABSTRACT

There is provided a method for joining the buss wires of a pair of flexible cables by splicing and encapsulating the ends of the cables together. This method involves the splicing of the two cables together by stripping oppositely disposed ends of the two cables such that the buss wires are left exposed. The exposed wires are inserted into respective ends of a connector tube formed of a material having a similar melting point, tensile strength and electrical conductivity properties to the buss wires disposed therein. Both ends of the connector tube are then welded to the oppositely disposed buss wires. Thereafter, the welded wires are encapsulated within an polymer encapsulation layer which overlaps with portions of the flexible sheath that had not been stripped. The polymer encapsulation layer is preferably one which exhibits a similar melting point and tensile strength to the flexible polymer sheath. As such, the two cables are joined together and adhered to each other via the polymer encapsulation layer so that the joined area exhibits tensile strength, flexibility, heat suitability, moisture resistance and dimensional characteristics similar to the cables themselves.

24 Claims, 4 Drawing Sheets

METHOD FOR JOINING MULTIPLE CONDUCTOR CABLES

The present invention relates generally to the joining of a pair of oppositely disposed cables by splicing together their respective conductor wires, and the formation of an encapsulation about the spliced section of the joined cables. More particularly, the present invention relates to a method for welding oppositely disposed conductor wires followed by forming a polymer encapsulation layer about the welded wires such that the encapsulated area has tensile strength, flexibility, thermal properties, moisture resistance and dimensional characteristics similar to the flexible polymer sheath of the cables.

BACKGROUND OF THE INVENTION

Electrical cables, such as heat trace cables, generally have inner conductive wires that are surrounded by one or more protective layers. The inner conductive wires and the surrounding protective layers are usually made of materials that are flexible enough to bend, but also rigid enough to retain nominal cable dimensions. Occasionally, longer lengths of cable are desired than are normally produced by existing production processes. In order to lengthen the cables, one end of a cable may be joined or appended to an end of another cable. When joining two cables, they must be joined electrically to permit electric current to flow therebetween and mechanically to provide sufficient structure to hold the cables together.

Electrical cables are typically joined electrically by splicing the wires disposed therein together, thereby forming a spliced section or area at the joined ends of the cables. The splicing process may be accomplished by soldering, welding or mechanically clamping the inner conductive wires of the two cables together. However, for such prior art splicing methods the bending strength at the spliced section is less than the bending strength of each of the original cables. Also, for the soldering process in particular, the tensile strength at the spliced section is less since the solder used for the soldering process typically consists of a different material than the wires. Accordingly, there is a need for a splicing process that provides a strong mechanical and electrical connection between the wires of joined cables without substantially sacrificing bending strength or tensile strength at the spliced section.

The use of a sleeve to join the ends of the cables is known in the art. For example, U.S. Pat. No. 4,057,187 to B. H. Cranston, which issued on Nov. 8, 1977, provides a method of joining two wires that includes aligning the ends of the wires within a sleeve and then detonating an explosive composition coated about the exterior surface of the sleeve. However, such explosive splicing processes can become expensive and hazardous to use.

Although the splicing process may provide a certain degree of mechanical support for holding the joined cables together, the present inventors have discovered that substantially greater mechanical support can be provided to the joined cables by encapsulating their spliced section.

Others have used a polymeric shrinking tube in an attempt at providing such mechanical support to a spliced section. In this regard, a spliced section is situated within the polymeric shrinking tube and then the tube is heated to shrink and conform to the outer surface of the spliced section. Examples of such shrinking tube processes may be found in U.S. Pat. No. 4,487,994 to G. Bahder, which issued on Dec. 11, 1984; U.S. Pat. No. 4,822,952 to C. Katz, et al., which issued on Apr. 18, 1989; and U.S. Pat. No. 5,194,692 to D. O. Gallusser, et al., which issued on Mar. 16, 1993.

However, polymeric shrinking tubes present a number of problems due to their lack of strength and flexibility. For example, a polymeric shrinking tube fails to provide the electrical insulation required by third party authorities, such as Underwriters Laboratories (U. L.) or Factory Mutual (FM), of heat trace cables. In addition, polymeric shrinking tubes often fail to prevent liquid, e.g., water/moisture, ingress to the conductive portions of the cables.

U.S. Pat. No. 4,654,474 to L. J. Charlebois, et al., which issued on Mar. 31, 1987, and U.S. Pat. No. 4,678,866 to L. J. Charlebois, which issued on Jul. 7, 1987, each provide a method for joining a pair of cables by providing a grounding bar to structurally bridge the cable ends together. Thereafter, multiple layers of tape are wrapped about the spliced region, including the grounding bar and a polyethylene material is extruded about the spliced region a mold.

U.S. Pat. No. 4,484,022 to H. Eilentropp, which issued on Nov. 20, 1984, provides a method of connecting two cables in which a filler tube is melted and compressed within an enclosed structure in order to produce a bond between the cables and the enclosed structure. The filler tube is made of a copolymer that has a melting or softening point that is considerably below the melting or softening point of the enclosed structure, as well as that of the outer sheath of the two cables.

None of the above patents describe or suggest the use of a polymer having chemical and physical properties that are substantially similar to the polymer layer that adjacently surrounds the wires of the cables, as provided by the present invention.

The present invention overcomes the disadvantages of conventional cable splicing by providing a method for welding the conductors (i.e., metallic wires) followed by polymer encapsulation. The present invention provides an encapsulated spliced section having tensile strength, flexibility, thermal properties, moisture resistance, and dimensional characteristic substantially similar or identical to the polymer sheath which typically encases or insulates the wires. Moreover, the polymer encapsulation section is formed using a powder polymeric material which, under appropriate heating and pressure conditions, forms a polymeric encapsulation section which does not have any voids, i.e., air bubbles, and exhibits substantially similar properties to that of the original flexible polymer sheath of the cables themselves, and physically bonds to the flexible polymer sheath. The present inventors have discovered that if a polymeric material is of a granular form rather than a power form, then undesirable voids can be formed which cause the resultant polymer encapsulation to substantially reduced flexibility, strength, temperature resistance, moisture resistance, and dimensional characteristics.

SUMMARY OF THE INVENTION

A method for joining a pair of oppositely disposed cables, each cable comprises at least one metallic wire disposed within a flexible polymer sheath, the method comprises the steps of: exposing oppositely disposed metallic wires from each cable; splicing together the oppositely disposed metallic wires, thereby forming a spliced section between the oppositely disposed metallic wires which is capable of transmitting an electric current or signal therebetween; and encapsulating the spliced section within a polymer encapsulation layer, the polymer encapsulation layer being formed from a polymeric material which exhibits substantially similar melting point and tensile strength properties to the flexible polymer sheath, whereby the encapsulated spliced section exhibits a tensile strength, flexibility, thermal properties, moisture resistance and dimensional characteristics similar to the cables themselves.

The spliced section is formed by inserting tile oppositely disposed metallic wires into an electrically conductive connector tube. The connector tube is preferably formed of a material having a similar melting point, tensile strength and electrical conductivity as the metallic wires disposed therein, and welding each end of the connector tube to their respective metallic wire. The welding preferably involves crimp welding of the opposite ends of the connector tube to their respective metallic wires.

The polymer encapsulation layer is formed about the spliced section by placing the spliced section within a mold wherein the polymeric material is disposed on all sides of the spliced section, and then compressing and heating the polymeric material, thereby forming the polymer encapsulation layer.

The polymeric material is preferably in powdered form with a particle size of at least 50% when passed through an 80 mesh screen for fluoropolymer family material for fluoropolymer based cables and a 20 mesh screen for polyolefin family material for polyolefin based cables. The polymeric material has a melt flow rate that is about 1 gram per ten minutes to about 10 grams per ten minutes for fluoropolymer based cables and about 0.2 gram per ten minutes to about 5 grams per ten minutes for polyolefin based cables. Also, the polymeric material is compressed about the spliced section at about 3,000 psi to 15,000 psi for all polymer based cables. Further, the polymeric material is heated to a temperature in the range between about 15° F. below the melting point of the polymeric material to about 35° F. above the melting point of the polymeric material, and more preferably about 500° F. to about 550° F. for ethylene tetrafluoroethylene (ETFE) and about 260° F. to about 300° F. for high density polyethylene (HDPE).

Preferably, the polymeric material is either a fluoropolymer or a polyolefin polymer. The fluoropolymer is one selected from the group consisting of: ethylene tetrafluoroethylene (ETFE) copolymers, fluorinated ethylene propylene (FEP) copolymers, ethylene-chlorotrifluoroethylene (ECTFE) copolymers, polychlorotrifluoroethylene (PCTFE) copolymers, perfluoro alkoxy polymers (PFA), polyvinylidene fluoride (PVDF) and other fluoropolymers. The polyolefin polymer is one selected from the group consisting of: low density polyethylene (LDPE), medium density polyethylene, high density polyethylene (HDPE), polypropylene (PP), polybutylene, ethylene propylene copolymers, ethylene vinyl acetate (EVAC) copolymers, ethylene ethylacrylate (EEA) copolymers, ethylene methyl acrylate (EMA) copolymers, linear low density polyethylene (LLDPE), ultra high molecular weight polyethylene (UHMWPE), and polyolefin polymers, copolymers and terpolymers.

It is preferred that each cable includes a pair of substantially parallel metallic wires that are at least one material selected from the group consisting of: conductive alloys, copper, nickel plated copper, and tin plated copper. The metallic wire is exposed from the flexible sheath by stripping the flexible sheath away from the metallic wire by any conventional mechanical or physical means.

The connector tube is fabricated from at least one material selected from the group consisting of: conductive alloys, copper, nickel plated copper and tin plated copper.

The flexible sheath, particularly a self regulating heat trace cable (SRCH), comprises a polymer core layer which covers the metallic wire. It is also preferable that the flexible sheath having an outer polymer jacket layer disposed thereabout such that the polymer core layer or flexible sheath is disposed between the metallic wire and the outer polymer jacket layer. The flexible sheath with outer polymer jacket layer further comprises an optional metal braid layer disposed about the outer polymer jacket layer such that the outer polymer jacket layer is disposed between the metal braid layer and the polymer core layer and an optional polymer over jacket layer disposed about the metal braid layer such that the metal braid layer is disposed between the polymer over jacket layer and the outer polymer jacket layer.

It is preferred that the flexible polymer sheath (i.e., polymer core layer), outer polymer jacket layer and polymer over jacket layer are all formed from either a fluoropolymer or a polyolefin polymer. The fluoropolymer is preferably at least one material selected from the group consisting of: ethylene tetrafluoroethylene (ETFE) copolymers, fluorinated ethylene propylene (FEP) copolymers, ethylene-chlorotrifluoroethylene (ECTFE) copolymers, polychlorotrifluoroethylene (PCTFE) copolymers, perfluoro alkoxy polymers (PFA), polyvinylidene fluoride (PVDF) and other fluoropolymers. The polyolefin polymer is one selected from a group consisting of: low density polyethylene (LDPE), medium density polyethylene, high density polyethylene (HDPE), polypropylene (PP), polybutylene, ethylene propylene copolymers, ethylene vinyl acetate (EVAC) copolymers, ethylene ethylacrylate (EEA) copolymers, ethylene methyl acrylate (EMA) copolymers, linear low density polyethylene (LLDPE), ultra high molecular weight polyethylene (UHMWPE), and polyolefin polymers, copolymers and terpolymers.

DETAILED DESCRIPTION OF THE PREFERRED EMBODIMENT

Figure 1:
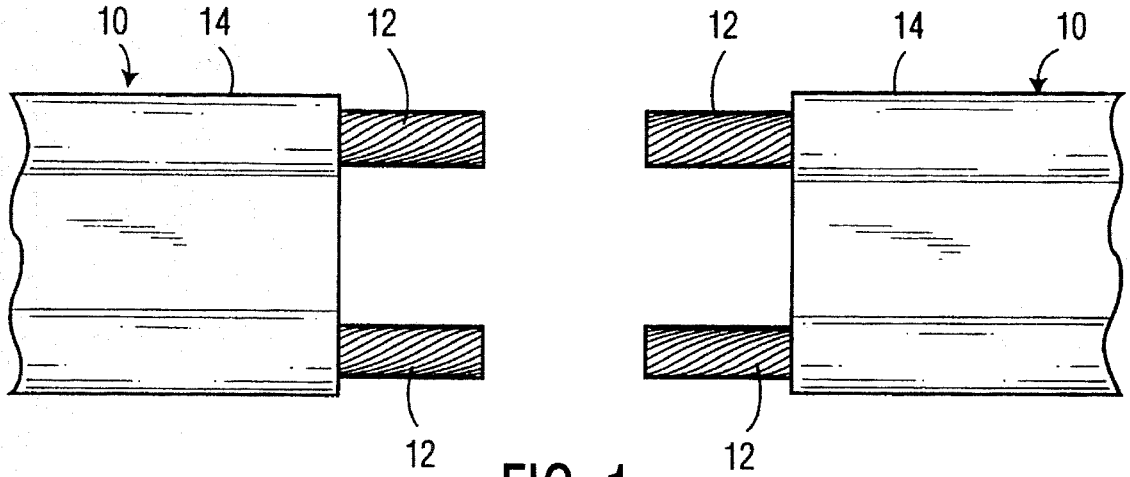
FIG. 1 is a top view of end portions of a pair of oppositely disposed cables in accordance with the preferred embodiment of the present invention with the end portions having been stripped of the original flexible polymer sheath.

The present invention can best be understood by reference to the drawings wherein FIG. 1 provides a pair of oppositely positioned and aligned end portions 10 of two separate cables, such as parallel self-regulating heat trace cables. Each end portion 10 comprises at least one metallic wire 12 encased within a flexible sheath 14. End portions 10 have been stripped to expose metallic wires 12 from flexible sheath 14. Preferably, metallic wires 12 are stranded conductors that are made of conductive alloys, copper, nickel plated copper, or tin plated copper.

Figure 2:
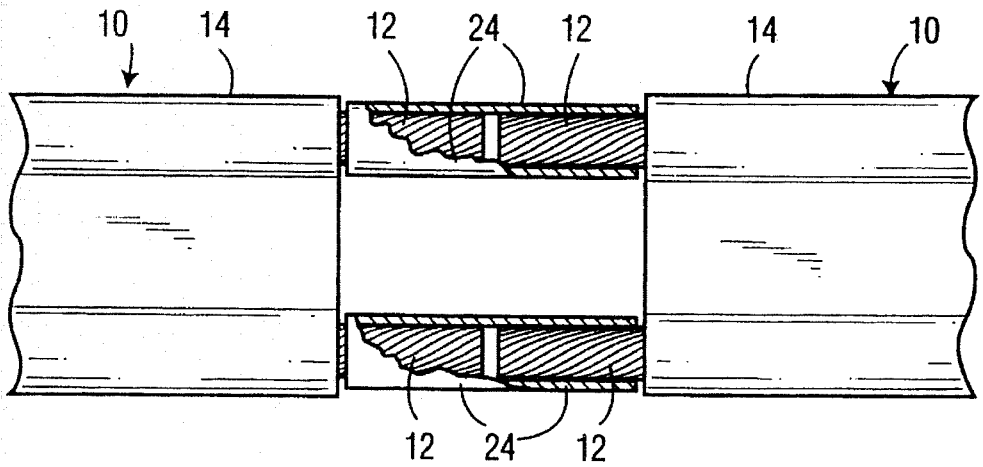
FIG. 2 is a top view of the end portions of FIG. 1 wherein the end portions of the exposed wires being inserted into a pair of connector tubes.
Figure 3:
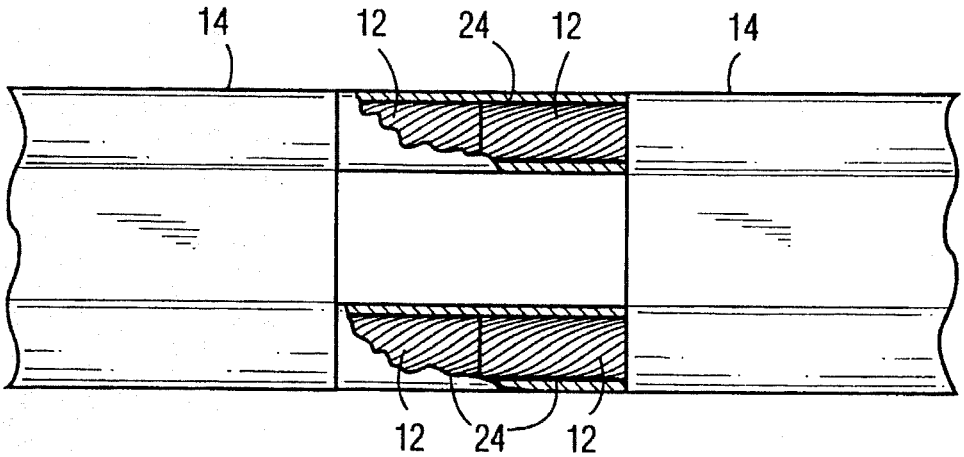
FIG. 3 is a top view of the end portions of FIG. 2 after opposite ends of each connector tube have been crimp welded about the inserted wires such that the oppositely disposed wires are securely affixed therein, thereby forming a spliced section.

Referring to FIGS. 2 and 3, the stripped and exposed metallic wires 12 of the oppositely disposed cables are joined or spliced together in order to form an electrical connection between end portions 10. The exposed end portions 10 are lined up with each other, and each exposed metallic wire 12 is inserted into an end of one of two connector tubes or sleeves 24. For the preferred embodiment, each connector tube 24 is formed of a material having a similar melting point, tensile strength and electrical conductivity properties as metallic wires 12 disposed therein. More preferably, each connector tubes 24 comprises a metallic composition, such as conductive alloys, copper, nickel plated copper or tin plated copper. After each metallic wire 12 has been fully inserted into its respective connector tube 24, as shown in FIG. 3, connector tubes 24 are welded about metallic wires 12. To weld connector tubes 24 to metallic wires 12, any conventional apparatus for welding similar portions of metal may be used, such as a crimp weld method which involves induction welding under pressure along the entire length of connector tubes 24. It is preferred that electrical connections to metallic wires 12 exist throughout the entire length of connector tubes.

Thus, the wire splicing process of the present invention is completed and a spliced section or area 34 that is capable of transmitting an electric current or signal through spliced section 34 is formed. As shown in FIG. 3, spliced section 34 includes connector tube 24 with stripped portions of metallic wires 12 securely disposed therein as well as portions of flexible polymer sheath 14.

Figure 4:
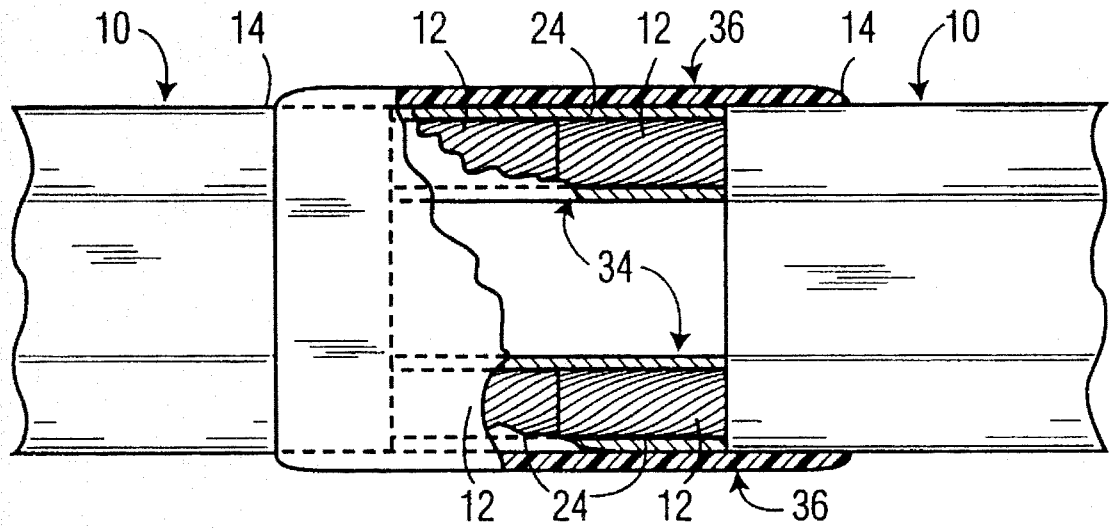
FIG. 4 is a top view of the end portions of FIG. 3 with a polymer encapsulation layer covering the spliced section in accordance with the preferred embodiment of the present invention.

Referring to FIG. 4, a polymer encapsulation layer 36 is formed about the newly formed spliced section 34. Preferably, polymer encapsulation layer 36 overlaps with portions of flexible polymer sheath 14 that had not been stripped to expose metallic wires 12 prior to the wire splicing process. For the preferred embodiment, polymer encapsulation layer 36 has properties that are substantially similar to the corresponding properties of flexible polymer sheath 14. More preferably, polymer encapsulation layer 36 exhibits a similar melting point, tensile strength and other mechanical and chemical properties to flexible polymer sheath 14. The combined polymer encapsulation layer 36 and spliced sections 34 exhibit tensile strength, flexibility, thermal properties, moisture resistance and dimensional characteristics similar to the cables themselves.

Figure 6:
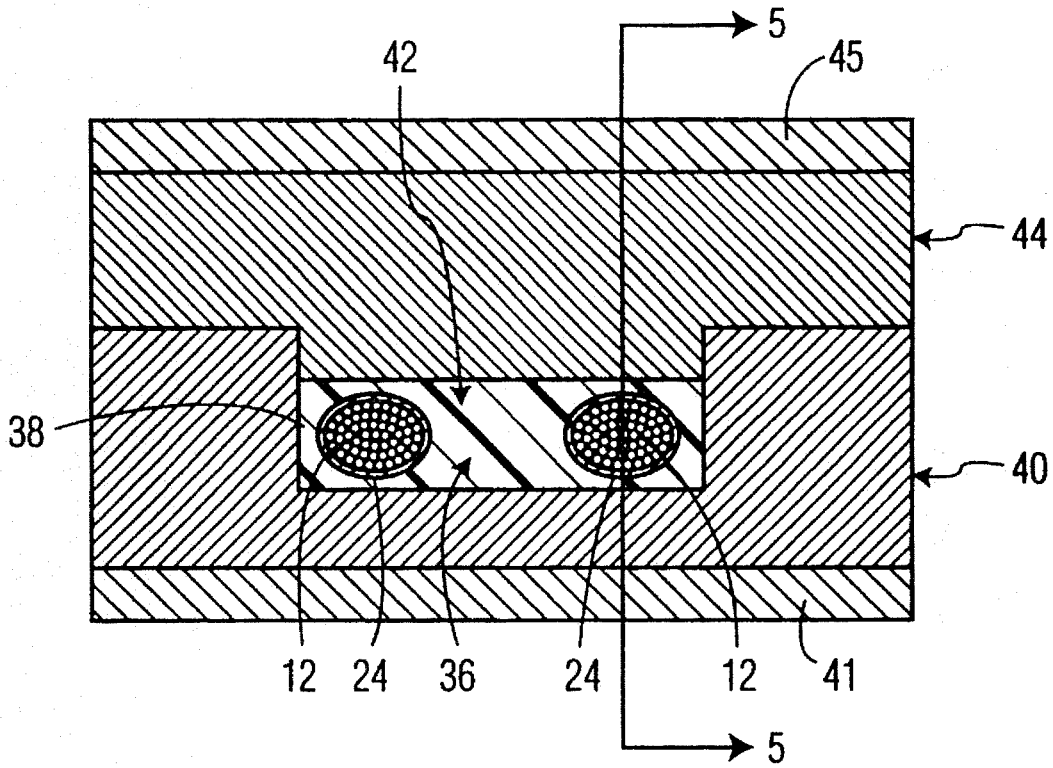
FIG. 6 is a front sectional view of the two-part mold along line 6—6 of FIG. 5.
Figure 5:
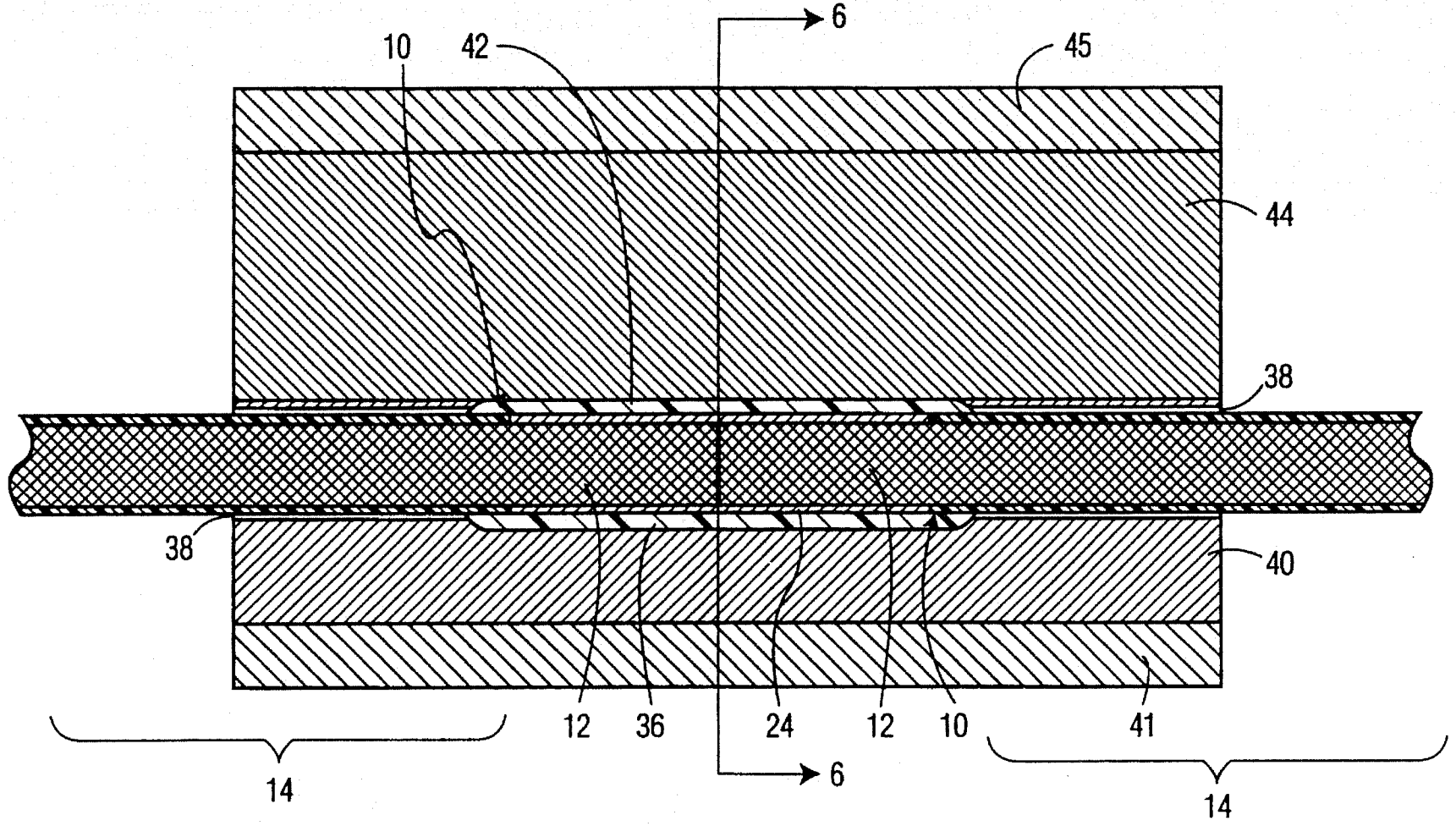
FIG. 5 is cross-sectional side view of a two-part mold having the polymer encapsulated cables of FIG. 4 disposed therein in accordance with the preferred embodiment of the present invention.

Referring to FIGS. 5 and 6, spliced section 34 is encapsulated by placing it into a slot or cavity 38 of a lower mold 40 of a two-part steel mold after lower mold 40 has been filled with a layer of a polymeric material 42. Polymeric material 42 used in the encapsulation process exhibits substantially similar melting points, tensile strength and other mechanical and chemical properties to flexible sheath 14. In one example of the preferred embodiment, if flexible polymer sheath 14 is made of a fluoropolymer, as preferred, then it would also be preferred that polymeric material 42 used in the encapsulation process also be made of the same fluoropolymer. In addition, it is preferred that polymeric material 42 have a melt flow index or melt flow rate of between about 1 gram per ten minutes to about 10 grams per ten minutes and be in a powdered form with a particle size of at least 50% through an 80 mesh screen. Most preferably, polymeric material 42 is a fluoropolymer such as ethylene tetrafluoroethylene (ETFE) copolymers, fluorinated ethylene propylene (FEP) copolymers, ethylene-chlorotrifluoroethylene (ECTFE) copolymers, polychlorotrifluoroethylene (PCTFE) copolymers, perfluoro alkoxy polymers (PFA), polyvinylidene fluoride (PVDF) and other fluoropolymers. Alternatively, polymeric material 42 can also be a polyolefin polymer have a melt flow Index or melt flow rate of between about 0.2 gram per ten minutes to about 5 grams per ten minutes and be in a powdered form with a particle size of at least 50% through a 20 mesh screen. The polymer material 42 may be selected from the group consisting of: low density polyethylene (LDPE), medium density polyethylene, high density polyethylene (HDPE), polypropylene (PP), polybutylene, ethylene propylene copolymers, ethylene vinyl acetate (EVAC) copolymers, ethylene ethylacrylate (EEA) copolymers, ethylene methyl acrylate (EMA) copolymers, linear low density polyethylene (LLDPE), ultra high molecular weight polyethylene (UHMWPE), and polyolefin polymers, copolymers and terpolymers.

Another layer of the same polymeric material 42 is then poured on top of spliced section 34 so that polymeric material 42 is disposed on all sides of spliced section 34. An upper mold 44 of the two-part steel mold is then placed on top of lower mold 40. Lower mold 40 is heated by means of lower heat plate 41 and upper mold 44 is heated by means of upper heat plate 45. Pressure is then applied to upper mold 44 such that it compresses polymeric material 42 about spliced section 34, and correspondingly, the two-part steel mold is then subjected to heated conditions so that polymeric material 42 is heated to a predetermined temperature. The two-part mold is heated via upper and lower heat plates (41, 45) to a temperature in the range between about 15° F. below the polymer's melting point to about 35° F. above the polymer's melting point. More preferably, the temperature is in the range between about 510° F. to about 550° F. for ETFE, so that polymeric material 42 is heated sufficiently to soften the flexible polymer sheath 14 as well as to soften or melt, completely or in part, polymeric material 42. Together with simultaneous application of pressure, polymeric material 42 is forced to form in and/or about spliced section 34, thereby causing polymeric material 42 to encapsulate spliced section 34 and bond to the polymer sheath 14. This provides spliced section 34 of cable 10 with a polymer encapsulation layer 36 that has strength and flexibility substantially similar or identical to flexible polymer sheath 14. Also, the heating temperature should be low enough to prevent heat from damaging the adjacent cable and high enough to melt polymeric material 42 for encapsulation and bonding. Any conventional type of heating and compressing method, such as placement of the two-part steel mold on heated plates (41, 45) of a laboratory press, may be used.

Figure 7:
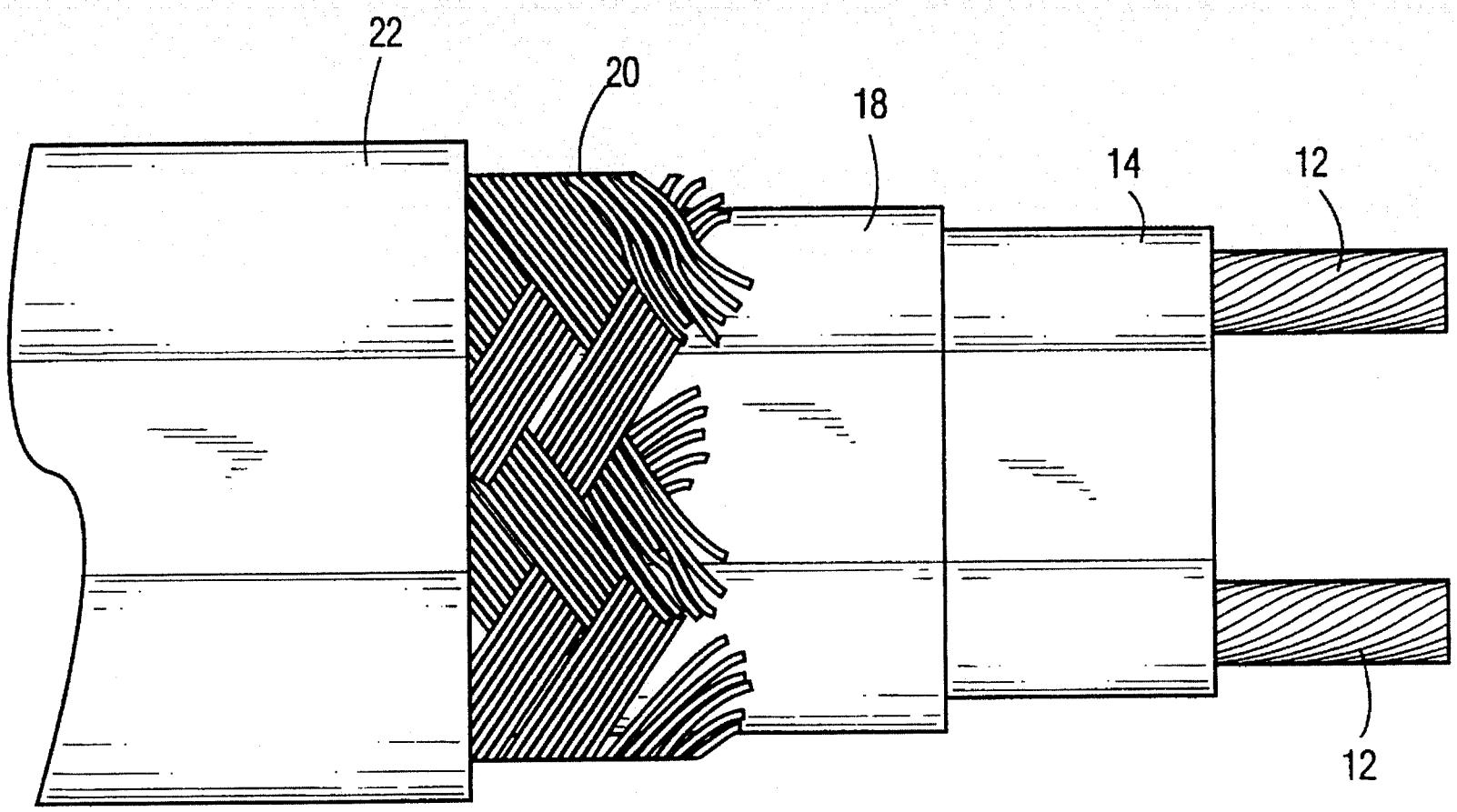
FIG. 7 is a top perspective view of an end portion of a stripped cable having optional protective layers disposed thereabout.

Referring to FIG. 7, there is shown an alternative embodiment, by example, of how flexible sheath 14, which covers metallic wires 12, may have additional covering layers. After polymer encapsulation layer 36 is formed, optional covering can be extruded and/or braided over polymer encapsulation layer 36 and adjacent heat trace cables. Preferably, for parallel self regulating heat tracing cables, a dielectric polymer jacket can be extruded over polymer encapsulation layer 36 and adjacent heat trace cable. As shown in FIG. 7, flexible sheath 14 is covered by outer polymer jacket layer 18. Optionally, a metal braid layer 20 and a polymer over jacket layer 22 may be formed about outer polymer jacket layer 18 in order to provide further protection from external environmental hazards, such as moisture or extreme temperatures, for the inner core of the cables. Flexible polymer sheath 14, outer polymer jacket layer 18 and optional polymer over jacket layer 22 are preferably formed of substantially the same polymeric material, and more preferably, a fluoropolymer or polyolefin polymer.

It is to be understood that end portion 10 of a cable shown in FIG. 7 has been stripped, by example, to clearly show each layer surrounding metallic wires 12 of the cable for the reader. Although stripping of end portion 10 is required, to a certain extent, in order to join end portions 10 of two cables pursuant to the method of the present invention, it is not necessary to strip each end portion 10 exactly as shown in FIG. 7. In fact, only metallic wires 12 and a portion of flexible polymer sheath 14 on either side of metallic wires 12 need to be exposed. For the preferred embodiment about a ¼ inch of flexible polymer sheath 14 is removed from each cable 10 to expose metallic wires 12.

The invention having been thus described with particular reference to the preferred forms thereof, it will be obvious that various changes and modifications may be made therein without departing from the spirit and scope of the invention as defined in the appended claims.

What is claimed is:

1. A method for joining a pair of oppositely disposed cables, wherein each cable comprises at least two metallic wires disposed within a flexible polymer sheath, the method comprising the steps of:

exposing at least two metallic wires from each cable;

splicing together oppositely disposed metallic wires, thereby forming a spliced section between the oppositely disposed metallic wires which is capable of transmitting an electric current or signal therebetween; and encapsulating said spliced section within a polymer encapsulation layer, said polymer encapsulation layer being formed from a polymeric material which exhibits substantially similar melting point and tensile strength properties to the flexible polymer sheath, whereby the encapsulated spliced section exhibits a tensile strength, flexibility, thermal properties, moisture resistance and dimensional characteristics similar to the cables themselves.

2. The method of claim 1 wherein said spliced section is formed by inserting the oppositely disposed metallic wires into a connector tube, said connector tube being formed of a material having similar melting point, tensile strength and electrical conductivity as the metallic wires disposed therein, and welding each end of said connector tube to their respective metallic wire.

3. The method of claim 2 wherein said welding is crimp welding, said crimp welding being induction welding under pressure, parallel to the length of said connector tube.

4. The method of claim 1 wherein the at least two metallic wires of each said cable are substantially parallel to each other.

5. The method of claim 1 wherein said metallic wires are at least one material selected from the group consisting of: conductive alloys, copper, nickel plated copper, and tin plated copper.

6. The method of claim 2 wherein said connector tube is at least one material selected from the group consisting of: conductive alloys, copper, nickel plated copper and tin plated copper.

7. The method according to claim 1 wherein said polymer encapsulation layer is formed about said spliced section by placing said spliced section within a mold wherein said polymeric material is disposed on all sides of said spliced section, compressed and heated, thereby forming said polymer encapsulation layer.

8. The method of claim 1 wherein said polymeric material is in powder form with a particle size of at least 50% when passed through 80 mesh screen.

9. The method of claim 1 wherein said polymeric material is in a powder form with a particle size of at least 50% when passed through a 20 mesh screen.

10. The method of claim 8, wherein said polymeric material has a melt flow rate that is about 1 gram per ten minutes to about 10 grams per minutes.

11. The method of claim 9, wherein said polymeric has a melt flow rate that is about 0.2 gram per ten minutes to about 5 grams per ten minutes.

12. The method of claim 1, wherein said polymeric material is compressed about said spliced section at about 3,000 psi to 15,000 psi.

13. The method of claim 8 wherein said polymeric material is a fluoropolymer.

14. The method of claim 13 wherein said fluoropolymer is one material selected from the group consisting of: ethylene tetrafluoroethylene copolymers, fluorinated ethylene propylene copolymers, ethylene-chlorotrifluoroethylene copolymers, polychlorotrifluoroethylene copolymers, perfluoro alkoxy polymers, polyvinylidene fluoride and other fluoropolymers.

15. The method of claim 9 wherein said polymeric material is a polyolefin polymer.

16. The method of claim 15 wherein said polyolefin polymer is one selected from a group consisting of: low density polyethylene, medium density polyethylene, high density polyethylene, polypropylene, polybutylene, ethylene propylene copolymers, ethylene vinyl acetate copolymers, ethylene ethylacrylate copolymers, ethylene methyl acrylate copolymers, linear low density polyethylene, ultra high molecular weight polyethylene, and polyolefin polymer, copolymers and terpolymers.

17. The method of claim 1 wherein said polymeric material is heated to a temperature in the range between about 15° F. below the melting point of said polymeric material to about 35° F. above the melting point of said polymeric material.

18. The method of claim 14 wherein said polymeric material is ethylene tetrafluoroethylene which is heated to a temperature in the range between about 500° F. to about 550° F.

19. The method of claim 16 wherein said polymeric material is high density polyethylene which is heated to a temperature in the range between about 260° F. to about 300° F.

20. The method of claim 1 wherein a bond is created between said polymeric material and portions of the flexible polymer sheath that are adjacent to said spliced section.

21. The method of claim 1 wherein said flexible sheath is a polymer core layer, said flexible sheath has an outer polymer jacket layer disposed thereabout such that said polymer core layer is disposed between said metallic wire and said outer polymer jacket layer.

22. The method of claim 21 further comprising a metal braid layer disposed about said outer polymer jacket layer such that said outer polymer jacket layer is disposed between said metal braid layer and said polymer core layer.

23. The method of claim 22 further comprising a polymer over jacket layer disposed about said metal braid layer such that said metal braid layer is disposed between said polymer over jacket layer and said outer polymer jacket layer.

24. The method of claim 23 wherein said polymer core layer, outer polymer jacket layer and polymer over jacket layer are all formed from either a fluoropolymer or a polyolefin polymer.

* * * * *